US011898770B2

(12) United States Patent
Huang et al.

(10) Patent No.: US 11,898,770 B2
(45) Date of Patent: Feb. 13, 2024

(54) MOVABLE AIR CONDITIONER AND CONTROL METHOD THEREFOR

(71) Applicant: GREE ELECTRIC APPLIANCES, INC. OF ZHUHAI, Guangdong (CN)

(72) Inventors: Zhihua Huang, Zhuhai (CN); Xinxiang Yao, Zhuhai (CN); Gang Yao, Zhuhai (CN); Haiqiang Huang, Zhuhai (CN); Qianglian Lin, Zhuhai (CN); Mengzhi Li, Zhuhai (CN); Yanzan Luo, Zhuhai (CN); Haishuang Zhu, Zhuhai (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 221 days.

(21) Appl. No.: 17/288,500

(22) PCT Filed: Dec. 17, 2018

(86) PCT No.: PCT/CN2018/121497

§ 371 (c)(1),
(2) Date: Apr. 23, 2021

(87) PCT Pub. No.: WO2020/082545

PCT Pub. Date: Apr. 30, 2020

(65) Prior Publication Data

US 2021/0389022 A1 Dec. 16, 2021

(51) Int. Cl.
*F24F 13/22* (2006.01)
*F24F 11/89* (2018.01)
(Continued)

(52) U.S. Cl.
CPC ..... *F24F 13/222* (2013.01); *F24F 11/30* (2018.01); *F24F 11/89* (2018.01); *F24F 11/52* (2018.01);
(Continued)

(58) Field of Classification Search
CPC .. F24F 1/039; F24F 1/04; F24F 13/222; F24F 2013/225; F24F 2140/30; F24F 11/89; F25B 2339/041; F25B 2339/047
See application file for complete search history.

(56) References Cited

U.S. PATENT DOCUMENTS

| | | | | |
|---|---|---|---|---|
| 4,248,057 | A | 2/1981 | Yaguchi | |
| 2006/0005561 | A1* | 1/2006 | Murphy | F24F 13/222 62/291 |
| 2011/0192567 | A1* | 8/2011 | Chiu | F24F 13/222 165/47 |

FOREIGN PATENT DOCUMENTS

| | | |
|---|---|---|
| CN | 2307227 Y | 2/1999 |
| CN | 202267191 U | 6/2012 |

(Continued)

OTHER PUBLICATIONS

Extended European Search Report for Application No. 18938011.6 dated Oct. 20, 2021 (8 pages).

*Primary Examiner* — Jerry-Daryl Fletcher
*Assistant Examiner* — Daniel C Comings
(74) *Attorney, Agent, or Firm* — J. Miguel Hernandez; James R. Gourley; Carstens, Allen & Gourley, LLP

(57) ABSTRACT

Movable air conditioner and a control method. The movable air conditioner includes a water receiving tray configured to receive condensed water generated by an evaporator of the movable air conditioner, a first water collection area, a second water collection area; a water guiding member configured to selectively guide the condensed water in the water receiving tray to the first water collection area or the second water collection area, and a controller configured to control the water guiding member to the guide condensed water in the water receiving tray to the first water collection area, and configured to control the water guiding member to guide the condensed water in the water receiving tray to the
(Continued)

second water collection area when a water level of the first water collection area reaches a preset value.

16 Claims, 4 Drawing Sheets

(51) Int. Cl.
*F24F 11/30* (2018.01)
*F24F 140/30* (2018.01)
*F24F 11/52* (2018.01)

(52) U.S. Cl.
CPC ..... *F24F 2140/30* (2018.01); *F25B 2339/047* (2013.01)

(56) References Cited

FOREIGN PATENT DOCUMENTS

| | | | | | |
|---|---|---|---|---|---|
| CN | 204421311 | U | | 6/2015 | |
| CN | 205351714 | U | | 6/2016 | |
| CN | 205878534 | U | | 1/2017 | |
| CN | 206160307 | U | | 5/2017 | |
| CN | 107560141 | A | | 1/2018 | |
| JP | S5339317 | U | | 4/1978 | |
| JP | H0270129 | U | | 5/1990 | |
| JP | 2002340368 | A | * | 11/2002 | ..... F24F 1/02 |
| JP | 2002340368 | A | | 11/2002 | |
| KR | 20160028727 | A | | 3/2016 | |
| KR | 20170002345 | A | | 1/2017 | |
| WO | 0016015 | A1 | | 3/2000 | |

* cited by examiner

MOVABLE AIR CONDITIONER AND CONTROL METHOD THEREFOR

CROSS REFERENCE TO RELATED APPLICATIONS

This application is a U.S. National Stage of International Application No PCT/CN2018/121497, filed on Dec. 17, 2018, and published as WO 2020/082545 A1 on Apr. 30, 2020, which is based on and claims priority to Chinese Patent Application No. 201811241037.8, filed on Oct. 24, 2018, the disclosure of which is incorporated herein by reference in its entirety. Every patent application and publication listed in this paragraph is hereby incorporated by reference in its entirety.

TECHNICAL FIELD

The present disclosure relates to a field of an air conditioner, and more particularly, to a movable air conditioner and a control method therefor.

BACKGROUND

When a movable air conditioner is in operation, condensed water generated is generally collected in a water receiving tray. To avoid producing potential safety hazards, water in the water receiving tray needs to be discharged timely.

In a related art, the water in the water receiving tray is guided into a water collection groove, and a water drawing flywheel structure is provided in the water collection groove, so that condensed water in the water collection groove is thrown onto fins of a condenser to be evaporated and to be cooled, thereby improving the performance of the condenser, consuming the condensed water, and prolonging a water overflow-proof time.

However, under conditions of high humidity, a speed at which condensed water is generated in the movable air conditioner is higher than a speed at which the water drawing flywheel consumes the condensed water. When the water collection groove is full of water, it cannot receive the condensed water in the water receiving tray any more, and the condensed water in the water receiving tray is not discharged timely, thus there is a potential safety hazard.

Moreover, when the water collection groove is full of water, the air conditioner should be turned off, and cannot be restarted until the condensed water in the water collection groove has been discharged. For example, under conditions of a high temperature and a high humidity, the air conditioner enters a full-water protection state within 3 to 5 hours, and water needs to be discharged frequently. However, the movable air conditioner prototype is relatively heavy, and when the water collection sink is full of water and the water needs to be poured, a power plug needs to be unplugged, and the prototype needs to be pushed to a toilet to have the water poured, thus the operation is inconvenient, and moreover potential safety hazards are increased.

SUMMARY

Some embodiments of the present disclosure provide a movable air conditioner and a control method therefor, so as to solve a problem that water is not discharged from a water receiving tray timely.

According to one aspect of some embodiments of the present disclosure, a movable air conditioner includes a water receiving tray configured to receive condensed water generated by an evaporator of the movable air conditioner, a first water collection area, a second water collection area, a water guiding member configured to selectively guide the condensed water in the water receiving tray to the first water collection area and/or the second water collection area, and a controller configured to control the water guiding member to the guide condensed water in the water receiving tray to the first water collection area, and configured to control the water guiding member to guide the condensed water in the water receiving tray to the second water collection area when a water level of the first water collection area reaches a preset value.

In some embodiments, the water guiding member is disposed below the water receiving tray and is movable relative to the water receiving tray.

In some embodiments, the movable air conditioner further includes a power mechanism electrically connected to the controller, wherein the power mechanism is connected to the water driving member and configured to drive the water guiding member to move.

In some embodiments, the water guiding member is rotatable relative to the water receiving tray.

In some embodiments, the water guiding member includes a first groove, and the first groove is configured to receive the condensed water flowing out of the water receiving tray.

In some embodiments, the water guiding member is provided with a water guiding structure, and the water guiding structure communicates with the first groove and is configured to guide the condensed water in the first groove out.

In some embodiments, the water guiding structure is provided at an end of the water guiding member; the water guiding structure includes a second groove; a groove bottom of the second groove is lower than a groove bottom of the first groove; one end of the second groove is an open structure; and the end of the second groove is away from the first groove.

In some embodiments, one end of the water receiving tray defines a dripping port, and the water guiding member is disposed below the dripping port.

In some embodiments, a movable air conditioner includes a water tank, wherein the water tank is disposed in the second water collection area and configured to collect the condensed water introduced by the water guiding member.

In some embodiments, the water tank is detachably disposed inside the movable air conditioner.

In some embodiments, a movable air conditioner includes a bottom tray, wherein the water tank is disposed on the bottom tray and located below the water receiving tray.

In some embodiments, a movable air conditioner includes a bottom tray, wherein the water tank is disposed on the bottom tray in a way that the water tank is pulled out and pushed in relative to the bottom tray.

In some embodiments, the movable air conditioner further includes a water sink disposed in the first water collection area and configured to collect the condensed water introduced by the water guiding member, and a water drawing apparatus disposed in the water sink and configured to throw the condensed water in the water sink onto a condenser of the movable air conditioner.

In some embodiments, the water guiding member is configured to selectively guide the condensed water in the water receiving tray to the water tank or to the water sink.

In some embodiments, a movable air conditioner includes a detection element electrically connected to the controller, wherein the detection element is configured to detect a water level of the water sink; and a signal is sent out to control the water guiding member to guide the condensed water in the water receiving tray to the water tank.

In some embodiments, the water tank and the water sink are provided below two ends of the water guiding member, respectively.

Some embodiments of the present disclosure provide a control method for the movable air conditioner above, including: controlling, by the controller, the water guiding member to guide the condensed water in the water receiving tray to the first water collection area, and controlling, by the controller, the water guiding member to guide the condensed water in the water receiving tray to the second water collection area when the water level of the first water collection area reaches the preset value.

The movable air conditioner according to the embodiments of the present disclosure includes the water guiding member and the controller, and the controller is configured to control the water guiding member to guide the condensed water in the water receiving tray to the first water collection area. When the water level of the first water collection area reaches a preset value, the water guiding member is controlled to guide the condensed water in the water receiving tray to the second water collection area. Therefore, when one water collection area cannot receive the condensed water, the water guiding member guide the condensed water to another water collection area, thereby avoiding the problem of the potential safety hazard caused by the condensed water not discharged from the water receiving tray timely.

DETAILED DESCRIPTION OF THE EMBODIMENTS

The technical solutions in the embodiments will be clearly and completely described below with reference to the accompanying drawings in the embodiments of the present disclosure. Apparently, the described embodiments are merely a part of the embodiments of the present disclosure, but not all embodiments of the present disclosure. Based on the embodiments of the present disclosure, all other embodiments obtained by a person having ordinary skill in the art without involving any creative efforts are within the protection scope of the present disclosure.

In the description of the present disclosure, it should be understood that the orientations or positional relationships indicated by terms "center", "longitudinal", "lateral", "front", "rear", "left", "right", "vertical", "horizontal", "top", "bottom", "inner", "outer", and the like, are the orientation or positional relationships shown on the basis of the drawings, and are merely intended to facilitate and simplify the description of the present disclosure, rather than to indicate or imply that the apparatus or element involved must have a particular orientation or be constructed and operated in a particular orientation, and therefore they cannot be construed as limitation on the protection scope of the present disclosure.

Figure 1:
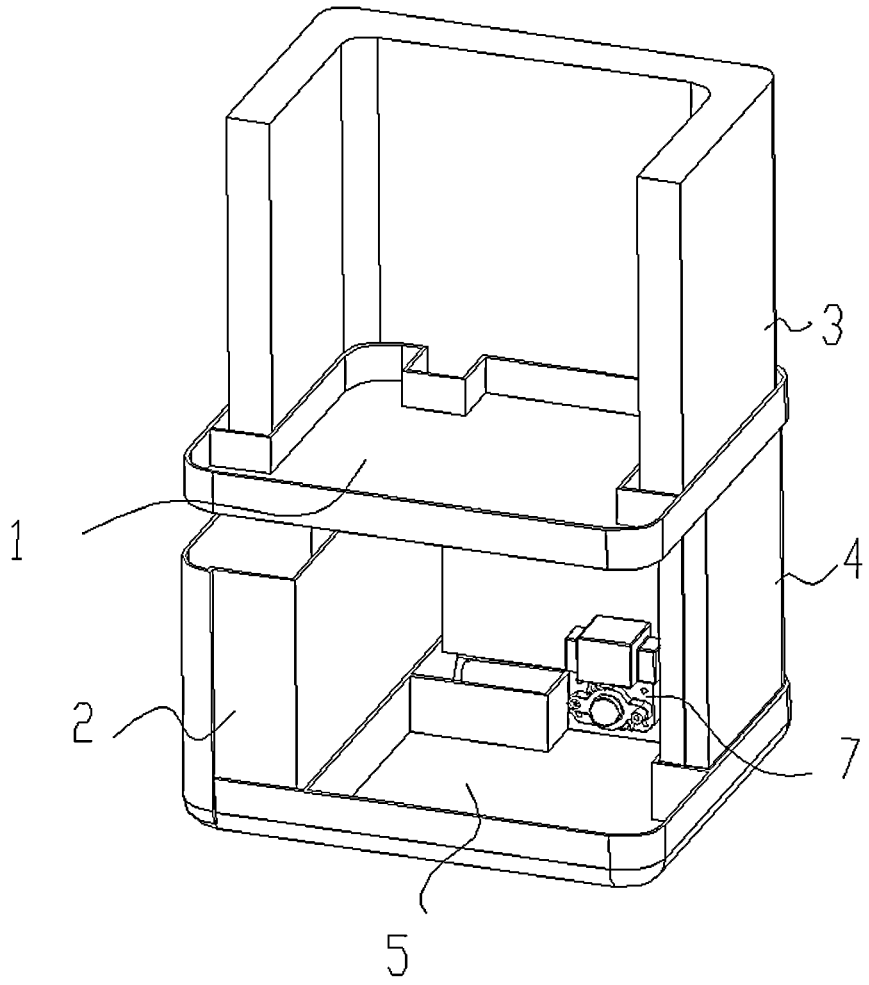
FIG. 1 is a partial structural schematic diagram showing a movable air conditioner according to some embodiments of the present disclosure.

FIG. 1 is a partial structural schematic diagram showing a movable air conditioner according to some embodiments of the present disclosure.

In some embodiments, the movable air conditioner includes a water receiving tray 1 for receiving condensed water generated by an evaporator 3 of the movable air conditioner.

In some embodiments, the movable air conditioner includes the evaporator 3. Further, the water receiving tray 1 is disposed below the evaporator 3.

In some embodiments, the movable air conditioner includes at least two water collection areas.

In some embodiments, the movable air conditioner includes a water guiding member 8 for guiding condensed water in the water receiving tray 1 to at least two water collection areas. When one water collection area cannot receive the condensed water, the water guiding member 8 guides the condensed water to another water collection area, so as to avoid a problem of a potential safety hazard caused by condensed water not discharged from the water receiving tray 1 timely.

In some embodiments, the movable air conditioner includes a first water collection area and a second water collection area, and the water guiding member 8 selectively guides condensed water in the water receiving tray 1 to the first water collection area and/or the second water collection area.

In some embodiments, the movable air conditioner includes a controller for controlling the water guiding member 8 to guide condensed water in the water receiving tray 1 to the first water collection area or to the second water collection area. When a water level of the first water collection area or the second water collection area reaches a preset value, the controller is configured to control the water guiding member 8 to guide the condensed water in the water receiving tray 1 to the second water collection area or to the first water collection area correspondingly.

In some embodiments, the movable air conditioner includes a water tank 2 provided in the first water collection area or second water collection area, and the water tank 2 is configured to collect condensed water guided by the water guiding member 8.

In some embodiments, the water tank 2 is detachably disposed inside the movable air conditioner.

In some embodiments, the movable air conditioner includes a bottom tray 5. The water tank 2 is disposed on the bottom tray 5 and is located below the water receiving tray 1. Further, the water tank 2 is disposed on the bottom tray 5 in such a way that the water tank 2 is pulled out and pushed in relative to the bottom tray 5 of the movable air conditioner, and the water tank 2 is pulled out to pour out the condensed water, which facilitate to pour water for the whole machine and improves a user's experience for the product.

In some embodiments, the water tank 2 is configured to collect the condensed water on the water receiving tray 1, and the water tank 2 may be removed from the movable air conditioner to pour water. These embodiments solve a problem of the movable air conditioner of the related art that, when the water tank is full of the condensed water, a power supply is required to be turned off, and the whole machine is pushed to a toilet or somewhere else to pour water, which makes it difficult for the movable air conditioner to discharge water.

Figure 2:
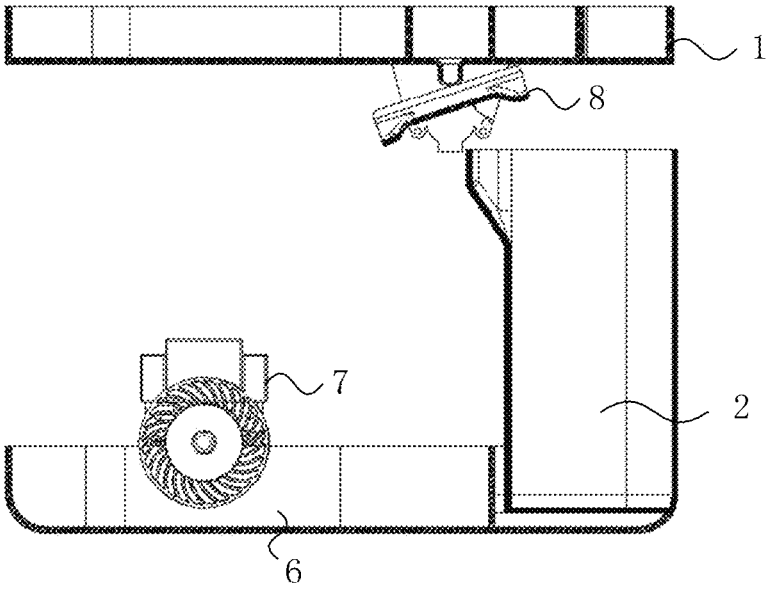
FIG. 2 is a schematic diagram showing a first operating state of a water guiding member of the movable air conditioner according to some embodiments of the present disclosure.
Figure 3:
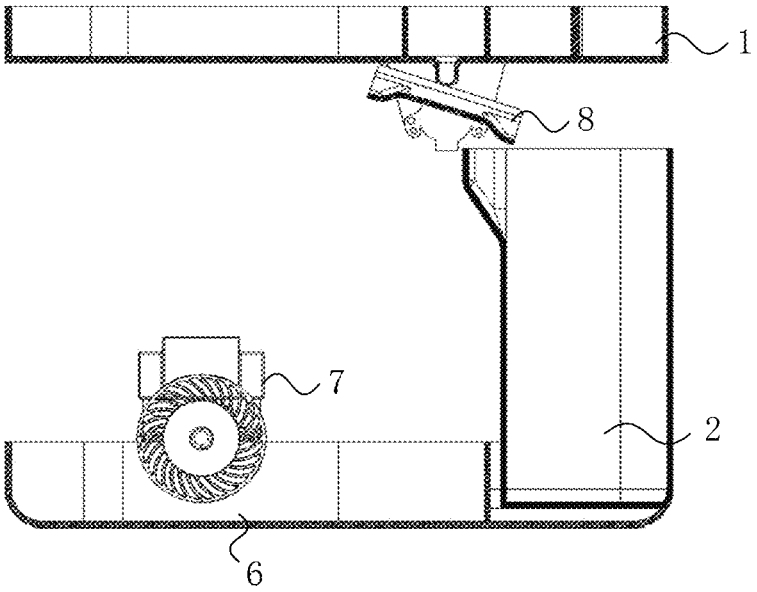
FIG. 3 is a schematic diagram showing a second operating state of the water guiding member of the movable air conditioner according to some embodiments of the present disclosure.

In some embodiments, as shown in FIGS. 2 and 3, the water guiding member 8 is disposed between the water receiving tray 1 and the water tank 2.

In some embodiments, the movable air conditioner further includes a condenser 4 disposed below the evaporator 3, and the water receiving tray 1 is disposed between the evaporator 3 and the condenser 4.

In some embodiments, the movable air conditioner includes a water sink 6 disposed in the second water collection area or first water collection area, and configured to collect the condensed water guided by the water guiding member 8.

In some embodiments, the water sink 6 is disposed on the bottom tray 5 and configured to collect the condensed water in the water receiving tray 1.

In some embodiments, the movable air conditioner includes a water drawing apparatus 7 disposed in the water sink 6 and configured to throw the condensed water in the water sink 6 onto the condenser 4 of the movable air conditioner. In some embodiments, the water drawing apparatus 7 includes a water drawing flywheel.

In some embodiments, the water drawing apparatus 7 is electrically connected to a controller for controlling the water drawing apparatus 7 to operate or not.

In some embodiments, the water sink 6 is located below the water receiving tray 1.

In some embodiments, the water guiding member 8 is configured to selectively guide the condensed water in the water receiving tray 1 to the water tank 2 or to the water sink 6. The water guiding member 8 is configured to guide water, so that no water path connection is required, and there is no potential water leakage hazard, thereby improving product reliability.

In some embodiments, the controller controls the water guiding member 8 to firstly guide the condensed water in the water receiving tray 1 to the water sink 6. When the water level of the water sink 6 reaches a preset height, the controller controls the water guiding member 8 to guide the condensed water in the water receiving tray 1 to the water tank 2, which prolongs water overflow-proof time of the whole machine, and avoids frequent shutdowns and starting due to protections of water overflow.

In some embodiments, the water tank 2 and the water sink 6 are disposed below two ends of the water guiding member 8 respectively.

In some embodiments, the water guiding member 8 is disposed below the water receiving tray 1 and is movable relative to the water receiving tray 1. In some embodiments, the water guiding member 8 is translational, rotatable or the like relative to the water receiving tray 1.

In some embodiments, as shown in FIGS. 2 and 3, the water guiding member 8 is rotatably provided relative to the water receiving tray 1 and disposed below the water receiving tray 1.

The controller controls the water guiding member 8 to rotate, and when one end of the water guiding member 8, which is located above the water sink 6, is lower than the other end thereof located above the water tank 2, the water guiding member 8 guides the condensed water in the water receiving tray 1 to the water sink 6.

The controller controls the water guiding member 8 to rotate, and when one end of the water guiding member 8, which is located above the water tank 2, is lower than the other end thereof located above the water sink 6, the water guiding member 8 guides the condensed water in the water receiving tray 1 to the water tank 2.

When the water sink 6 is full of water, the condensed water is guided to the water tank 2 and collected therein, thereby avoiding rapid and repeated protections for water overflow. Moreover, the water tank 2 can be pulled out, which facilitates to pour water.

In some embodiments, the movable air conditioner includes a power mechanism 9 electrically connected to the controller. The power mechanism 9 is connected to the water guiding member 8 to drive the water guiding member. The power mechanism 9 provides a power to the water guiding member 8 under the control of the controller.

In some embodiments, the power mechanism 9 includes a driving shaft connected to the water guiding member 8. The power mechanism 9 provides the power to force the driving shaft to rotate, so as to drive the water guiding member 8 to rotate.

In some embodiments, the power mechanism 9 includes a motor, which is connected to the water guiding member 8 to drive the water guiding member. The controller is electrically connected to the motor and configured to control a forward or reverse rotation of the motor. When the motor rotates in a forward or reverse direction, the water guiding member 8 leans in different directions, so as to guide the condensed water to the water tank 2 or the water sink 6 respectively, thus the water path is switched, and the structure is simple and reliable.

Further, a middle portion of the water guiding member 8 is provided with a motor shaft mounting hole for arranging the driving shaft of the motor.

In some embodiments, the movable air conditioner includes a detection element that is electrically connected to the controller. The detection element is a water level gauge in the prior art and configured to detect the water level of the water sink 6. When the water level of the water sink 6 reaches a preset value a signal is sent out, so that the controller controls the water guiding member 8 to guide the condensed water in the water receiving tray 1 to the water tank 2.

Figure 5:
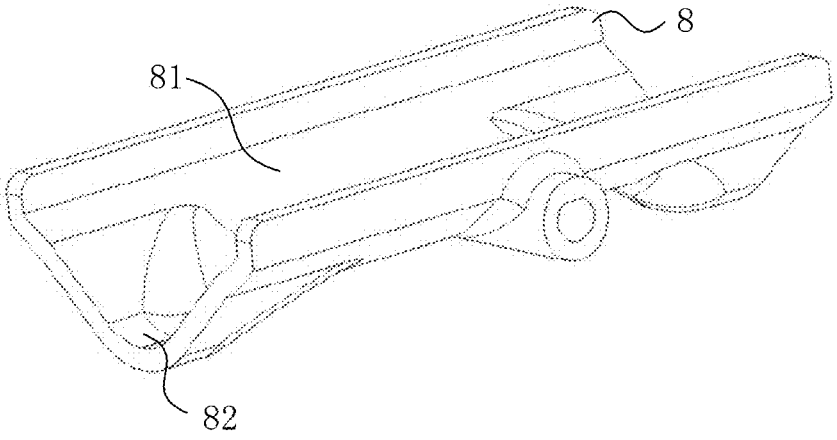
FIG. 5 is a schematic diagram showing the water guiding member of the movable air conditioner according to some embodiments of the present disclosure.
Figure 6:
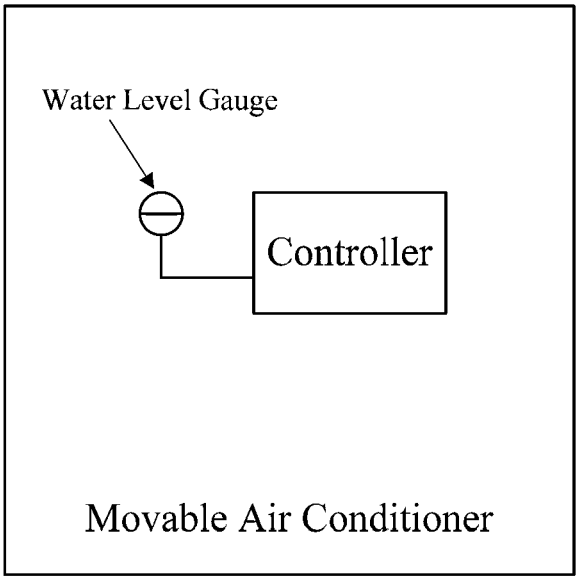
FIG. 6 is a schematic diagram showing a controller, and a detection element namely a water level gauge in the movable air conditioner of the present disclosure.

In some embodiments, as shown in FIG. 5, the water guiding member 8 includes a first groove 81 for receiving the condensed water flowing out of the water receiving tray 1. The water guiding member 8 is groove-shaped, which facilitates to guide water.

In some embodiments, the water guiding member 8 is provided with a water guiding structure 82 which communicates with the first groove 81 and is configured to guide the condensed water in the first groove 81.

In some embodiments, the water guiding structure 82 is provided at an end of the water guiding member 8, and the water guiding structure 82 includes a second groove. The groove bottom of the second groove is lower than the groove bottom of the first groove 81, and one end of the second groove, which is away from the first groove 81, is an open structure. The condensed water in the first groove 81 enters the second groove and flows out of the end of the open structure of the second groove.

Further, two ends of the water guiding member 8 are provided with the water guiding structures 82. One water guiding structure 82 is located above the water tank 2, and the other water guiding structures is located above the water sink 6.

Figure 4:
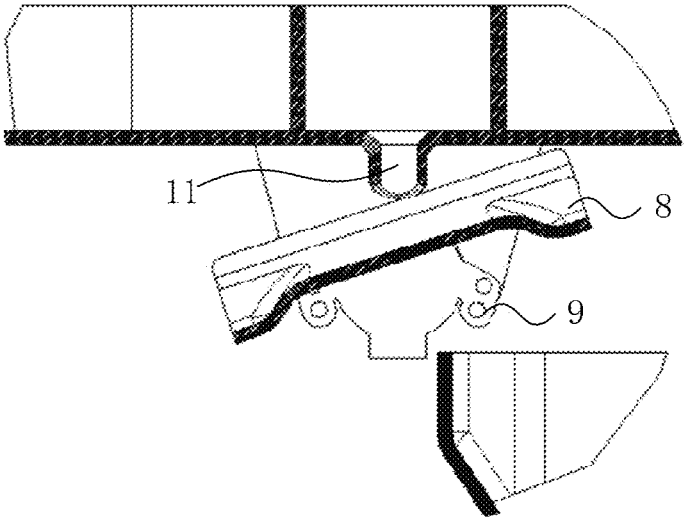
FIG. 4 shows a partial structural schematic diagram of FIG. 2.

In some embodiments, as shown in FIG. 4, the water receiving tray 1 defines a dripping port 11, and the water guiding member 8 is disposed below the dripping port 11. Condensed water received by the water receiving tray 1 flows to the water guiding member 8 through the water dripping port 11.

In some embodiments, the motor is fixed below the dripping port 11 of the water receiving tray 1, and the water guiding member 8 is attached to the driving shaft of the motor.

In some embodiments, the movable air conditioner further includes a compressor disposed on the bottom tray 5 and below the water receiving tray 1.

In some specific embodiments of the movable air conditioner, the condenser 4 and the water drawing apparatus 7 of the whole machine are fixed on the bottom tray 5. The water receiving tray 1 is disposed between the evaporator 3 and the condenser 4, and the water receiving tray 1 is configured to collect the condensed water generated by the evaporator 3. The water tank 2 is further disposed below the water receiving tray 1, and the water tank 2 may be pulled out to pour water independently.

The water guiding member 8 is disposed between the water receiving tray 1 and the water tank 2. The water guiding member 8 has a groove-shaped structure, and two ends of the water guiding member 8 are provided with the water guiding structures 82 to guide water.

At an initial stage of start-up, the controller controls the motor to rotate, and the water guiding member 8 is inclined to one side where the water sink 6 is located, as shown in FIG. 2. Condensed water flows into the water sink 6 through the water guiding member 8, and is drawn by the water drawing apparatus 7, and is thrown onto the condenser 4, so as to cool the condenser 4 with water.

The detection element is disposed on the bottom tray 5. When the water level of the water sink 6 reaches the preset value of the water level predetermined in the detection element, for example, when there will be water overflow, the detection element sends out a signal, and the controller controls the motor to rotate reversely, so that the water guiding member 8 is inclined to another side where the water tank 2 is located. As shown in FIG. 3, the condensed water flows into the water tank 2 through the water guiding member 8, thereby prolonging the water overflow-proof time of the whole machine.

When the water level of the water tank 2 reaches a certain height, the user is reminded to pull out the water tank to pour water, so as to avoid repeatedly shutdowns to pour water, thereby improving the users' experience and safety.

In some embodiments, the water guiding member 8 is also U-shaped or has any other shape.

In some embodiments, a water level sensing apparatus is disposed in the water tank 2, and a sound is automatically sent to alarm the user to pour water when the water tank is full of water.

In some embodiments, the water tank 2 is also provided with a transparent glass to allow the user to observe the water level of the water tank 2.

Some embodiments also provide a control method of the movable air conditioner described above, including:

controlling, by a controller, a water guiding member 8 to guide condensed water in a water receiving tray 1 to a first water collection area;

controlling, by the controller, the water guiding member 8 to guide condensed water in the water receiving tray 1 to a second water collection area when a water level of the first water collection area reaches a preset value.

It should be understood that the terms "first", "second", "third" and the like are used in the description of the present disclosure to define parts merely in order to facilitate distinguishing the parts. If not stated otherwise, these above-mentioned terms have no specific meanings, and therefore are not to be construed as limitation on the protection scope of the present disclosure.

Finally, it should be noted that the above embodiments are only used to illustrate but not intended to limit the technical solutions of the present disclosure. Although the present disclosure has been described in detail with reference to some embodiments, a person having ordinary skill in the art should understand that modification of the disclosed specific implementations or equivalent replacement of some technical features may be made without departing from the spirit of the technical solutions of the present disclosure, and all these modification and replacement should be within the scope of the technical solutions claimed in the present disclosure.

What is claimed is:

1. A movable air conditioner having a water guiding member, wherein the air conditioner comprises:

a water receiving tray configured to receive condensed water generated by an evaporator of the movable air conditioner;

a first water collection area;

a second water collection area;

the water guiding member configured to selectively guide the condensed water in the water receiving tray to the first water collection area or the second water collection area;

a controller configured to control the water guiding member to the guide condensed water in the water receiving tray to the first water collection area, and configured to control the water guiding member to guide the condensed water in the water receiving tray to the second water collection area when a water level of the first water collection area reaches a preset value;

the water guiding member comprises a first groove and a water guiding structure;

the first groove is configured to receive the condensed water flowing out of the water receiving tray;

the water guiding structure communicates with the first groove and is configured to guide the condensed water in the first groove out;

the water guiding structure is provided at an end of the water guiding member; the water guiding structure comprises a second groove, a groove bottom of the second groove is lower than a groove bottom of the first groove; one end of the second groove is an open structure; and the end of the second groove is away from the first groove.

2. The movable air conditioner according to claim 1, wherein the water guiding member is disposed below the water receiving tray and is movable relative to the water receiving tray.

3. The movable air conditioner according to claim 2, further comprising a power mechanism electrically connected to the controller, wherein the power mechanism is connected to the water guiding member and configured to drive the water guiding member to move.

4. The movable air conditioner according to claim 3, wherein the water guiding member is rotatable relative to the water receiving tray.

5. The movable air conditioner according to claim 2, wherein the water guiding member is rotatable relative to the water receiving tray.

6. The movable air conditioner according to claim 1, wherein one end of the water receiving tray defines a dripping port, and the water guiding member is disposed below the dripping port.

7. The movable air conditioner according to claim 1, comprising a water tank, wherein the water tank is disposed in the second water collection area and configured to collect the condensed water guided by the water guiding member.

8. The movable air conditioner according to claim 7, wherein the water tank is detachably disposed inside the movable air conditioner.

9. The movable air conditioner according to claim 7, comprising a bottom tray, wherein the water tank is disposed on the bottom tray and located below the water receiving tray.

10. The movable air conditioner according to claim 7, comprising a bottom tray, wherein the water tank is disposed on the bottom tray in a way that the water tank is pulled out and pushed in relative to the bottom tray.

11. The movable air conditioner according to claim 7, further comprising:

a water sink disposed in the first water collection area and configured to collect the condensed water guided by the water guiding member; and a water drawing apparatus disposed in the water sink and configured to throw the condensed water in the water sink onto a condenser of the movable air conditioner.

12. The movable air conditioner according to claim 11, wherein the water guiding member is configured to selectively guide the condensed water in the water receiving tray to the water tank or to the water sink.

13. The movable air conditioner according to claim 12, comprising a detection element electrically connected to the controller, wherein the detection element is a water level gauge configured to detect a water level of the water sink; and a signal is sent out when the water level reaches a preset value, so that the controller controls the water guiding member to guide the condensed water in the water receiving tray to the water tank.

14. The movable air conditioner according to claim 11, wherein the water tank and the water sink are provided below two ends of the water guiding member, respectively.

15. The movable air conditioner according to claim 1, further comprising:

a water sink disposed in the first water collection area and configured to collect the condensed water guided by the water guiding member; and a water drawing apparatus disposed in the water sink and configured to throw the condensed water in the water sink onto a condenser of the movable air conditioner.

16. A control method of a movable air conditioner according to claim 1, comprising:

controlling, by the controller, the water guiding member to guide the condensed water in the water receiving tray to the first water collection area;

controlling, by the controller, the water guiding member to guide the condensed water in the water receiving tray to the second water collection area when the water level of the first water collection area reaches the preset value.

* * * * *